United States Patent [19]

Kazak et al.

[11] Patent Number: 4,610,303

[45] Date of Patent: Sep. 9, 1986

[54] METHOD OF UNDERGROUND GASIFICATION OF A SERIES OF GENTLY DIPPING AND INCLINED COAL SEAMS

[75] Inventors: Vadim N. Kazak; Valery K. Kapralov, both of Moscow; Alfei F. Volk, deceased, late of Zaporozhie, all of U.S.S.R., by Igor F. Volk, administrator

[73] Assignee: Vsesojuznoe Nauchno-Proizvod Stvennoe Obiedinenie "Sojuzpromgaz", U.S.S.R.

[21] Appl. No.: 671,941

[22] Filed: Nov. 16, 1984

[51] Int. Cl.[4] ..... E21B 43/24; E21B 43/243; E21C 43/00

[52] U.S. Cl. ..... 166/251; 48/210; 48/DIG. 6; 166/258; 166/259

[58] Field of Search ..... 166/259, 256, 258, 259, 166/251; 48/210, DIG. 6

[56] References Cited

U.S. PATENT DOCUMENTS

| | | | |
|---|---|---|---|
| 4,083,402 | 4/1978 | Antonova et al. | 166/256 X |
| 4,089,374 | 5/1978 | Terry | 166/258 X |
| 4,243,101 | 1/1981 | Grupping | 166/258 X |
| 4,422,505 | 12/1983 | Collins | 166/256 |
| 4,448,252 | 5/1984 | Stoddard et al. | 166/258 X |

FOREIGN PATENT DOCUMENTS 59640 4/1941 U.S.S.R. .

OTHER PUBLICATIONS

M. A. Iophif and I. A. Turchaninov, ZNIIpodzemgas Proceedings, No. 6, Moscow, 1962, pp. 43–54–Russian with English Translation.

*Primary Examiner*—Stephen J. Novosad
*Attorney, Agent, or Firm*—Steinberg & Raskin

[57] ABSTRACT

A method of underground gasification of a series of gently dipping and inclined coal seams comprises the steps of determining the depth of occurrence and the thickness of each coal seam in said series thereof, opening the seams by drilling operating wells, interconnecting them within the given seam, setting the coal afire, and gasifying the seams. A safe mining depth is determined for each coal seam in the series and said series of the seams is gasified upwards when a rock thickness therebetween exceeds a safe mining depth for the underlying seam and downwards when the rock thickness therebetween exceeds said safe depth, a firing boundary of the underlying seam being shifted towards a coal pillar by an amount equal to or greater than a first spacing of rock caving in the roof of a gasified layer.

5 Claims, 3 Drawing Figures

METHOD OF UNDERGROUND GASIFICATION OF A SERIES OF GENTLY DIPPING AND INCLINED COAL SEAMS

BACKGROUND OF THE INVENTION

The invention relates to mining and in particular to a method of pitless extraction of mineral resources occurring as a series of seams, say, coal and oilshale seams.

The method in compliance with the invention may be used to best advantage in underground gasification of coal seams occurring at a pitch angle of up to 40°.

The proposed method may be also used in underground gasification of oil shales occurring as a series of seams.

At the present time underground gasification techniques are used to gasify single coal seams or a series of individual coal seams. Most of coal formations are composed of a series of seams. To gasify all seams in the series, the techniques involved should ensure a decrease in rock deformation associated with the gasification of the seams comprised in the series. Otherwise some coal seams may not be gasified or a gaseous medium and gas may penetrate to the surface of the earth, a factor violating a normal production process and contaminating the environments.

A known method of underground gasification of a series of gently dipping seams (cf. U.S. Pat. No. 4,089,374 Cl. 166–259 published May 16, 1978) involves simultaneous gasification of two adjacent coal seams, which may cause interconnection of degasified seams due to a seam-spacing downfall and violation or termination of a gasification process. Another disadvantage of the aforesaid method is that, in simultaneous gasification of two or more seams, the surface of the earth may collapse and gas may penetrate to said surface, thereby contaminating the environments.

Another known method of gasifying a series of coal seams (cf. M. A. Iophis and I. A. Turchaninov, VNIIpodzemgas proceedings, No. 6, Moscow, 1962, pp 43–54, in Russian) comprises the steps of determining the depth of occurrence and the thickness of each coal seam in the series, opening each seam in the series by drilling inclined horizontal or inclined wells, interconnecting said wells within the coal seam, setting afire the coal, thus establishing gasification passages and gasifying each subsequent seam in the series on completion of gasification of the preceding seam by supplying a gaseous medium into the first wells and removing the produced gas from the second wells.

A disadvantage of the known method is that it may neither preclude penetration of a gaseous medium and gas to the surface of the earth in gasification of seams in a series nor prevent the associated contamination of the environments and downfalls.

SUMMARY OF THE INVENTION

The object of the invention is to create a method of underground gasification of a series of gently dipping and inclined coal seams, which would ensure gasification of all seams in a series without any downfalls or breakthrough of a gaseous medium and gas to the surface of the earth and preclude a destructive effect of degasification of coal seams upon one another, which is associated with a rock shift, owing to a proper choice of operational sequence in gasifying a series of seams.

There is provided a method of underground gasification of a series of gently dipping and inclined coal seams comprising the steps of determining the depth of occurrence and the thickness of each coal seam in the series, opening said seams by drilling operating injection and production wells, interconnecting said wells within the coal seam, setting afire the coal, thus establishing gasification passages within said coal seam, and gasifying each subsequent seam on completion of gasification of the preceding seam by supplying a gaseous medium into the first wells and removing the produced gas from the second wells, in which, according to the invention, a safe mining depth is determined for each seam in the series and the series of said coal seams is gasified upwards from the underlying seam to the overlying seam when a rock thickness therebetween exceeds a safe mining depth for the underlying seam and downwards from the overlying seam to the underlying seam when a rock thickness therebetween is less than the safe mining depth of the underlying layer, gasification of each subsequent seam being accomplished after the rock overlying the gasified seam is no longer shifted, the shift thereof being associated with said gasification, a firing boundary of the underlying seam being shifted towards a coal pillar by an amount equal to or greater than a first spacing of rock caving in the roof of the gasified layer.

It is of advantage that the safe mining depth H for each seam in the series should be determined from the formula $$H = n \cdot m \text{ at } H < H_1$$

where m is the thickness of the given coal seam in the series;

$H_1$ is the depth of occurrence of the given seam in the series; and n is a coefficient accounting for propagation of cracks in the event of rock caving in the roof of the gasified layer.

The value of the coefficient n is known from experience gained in underground gasification of coals under various mining conditions.

The method in compliance with the invention permits gasifying a series of coal seams successively in a predetermined sequence, an advantage protecting the surface of the earth against penetration of a gaseous medium and gas attributable to a rock shift and allowing full use of coal reserves in all seams in a coal formation with minimum losses.

During gasification of a series of coal seams in descending order with the height of a zone wherein a rock downfall occurs exceeding the rock thickness between contiguous seams, it is preferable that, before gasifying the underlying seam, the degasified space of the overlying seam should be stopped up with a fluid stowage material, a factor substantially decreasing a harmful effect of rock deformation upon a production process. Moreover, downfalls and gas leaks will be fewer.

It is also preferable that, during gasification of a series of coal seams in descending order with a rock thickness between contiguous seams being smaller than half a thickness of the underlying coal seam, the two contiguous coal seams should be gasified simultaneously by gasifying the underlying seam and involving the overlying seam in coal gasification, an advantage making it possible to attain a direct economic effect owing to the fact that only one seam has to be prepared for gasification (and not two seams).

BRIEF DESCRIPTION OF THE DRAWINGS

The invention will now be described in more detail with reference to a specific embodiment thereof, taken in conjunction with the accompanying drawings, wherein.

DESCRIPTION OF THE PREFERRED EMBODIMENTS

Figure 1:
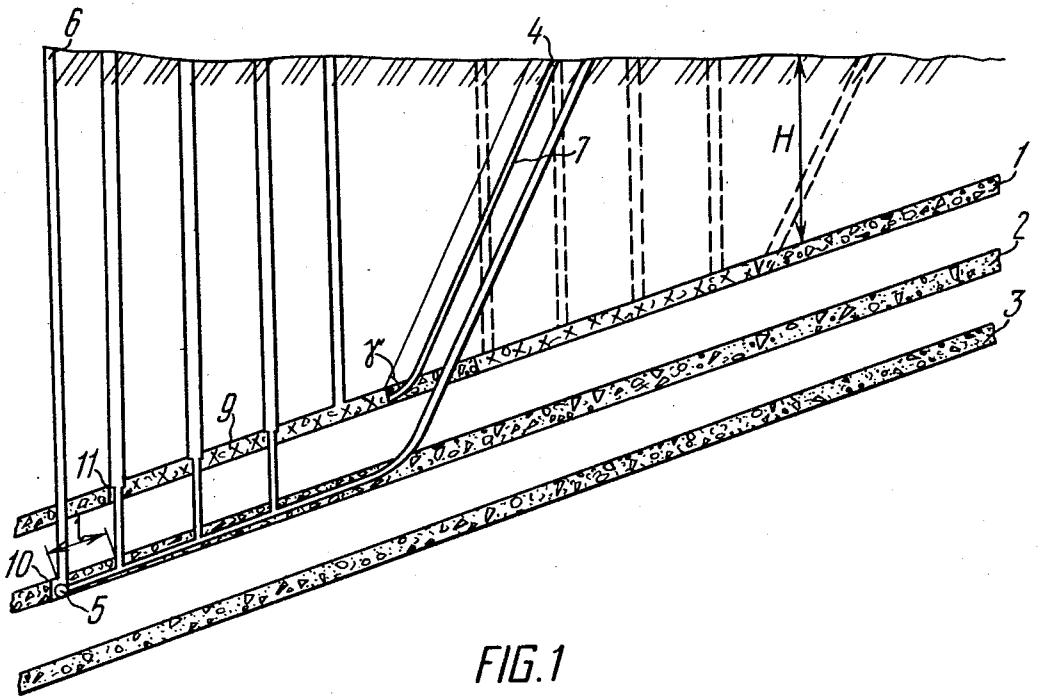
FIG. 1 shows arrangement of wells across a series of coal seams according to the invention.

The method forming the subject of the present invention is accomplished in the following manner.

The initial step is to determine the sequence in which a series of coal seams 1, 2 and 3 (FIG. 1) will be gasified. This is done by determining a safe mining depth H for each seam and comparing its value for the seam 1 with the depth of occurrence thereof, while its value for the seams 2 and 3 is compared with the thickness of seam spaces. With the thickness of the seam spaces being less than H, gasification will be effected in descending order from the upper seam 1 in the series to the lower seam 3 therein. Conversely, when the thickness of the seam spaces exceeds H, gasification will be effected in ascending order from the lower seam 3 in the series to the upper seam 1 therein. When the seam 1 is inclined, its depth of occurrence and a safe mining depth are compared to determine possible gasification boundaries so that a gaseous medium and gas do not penetrate to the surface of the earth.

The safe mining depth H is determined from the formula $$H = n \cdot m \text{ at } H < H_1$$

(stated differently, gasification will necessarily involve gas penetration if the safe mining depth is equal to or exceeds the depth of occurrence of said seam) where $H_1$ is the depth of occurrence of said seam in the series;

m is the thickness of the gasified layer; and n is a coefficient accounting for propagation of cracks in the event of rock caving in the roof of the gasified seam.

The coefficient n depends on physical and mechanical properties of the rock, thickness of the gasified seam and on gasification techniques used. The value of the coefficient n is known from experience gained in gasification of coal seams under various mining conditions.

The series of said coal seams is opened by drilling a system of inclined, inclined horizontal and vertical wells 4, 5 and 6 (FIG. 1), respectively.

The vertical wells 6 are connected in the given seam with the wells 4 and 5 drilled in said seam by known methods, for example, through hydrofracture, pyrogenous filtration connection and the like.

Inclined portions 7 and 8 (FIGS. 1, 2) of the wells 4 and 5 (before entry to the seam) are arranged beyond the rock shift zone.

To enable better understanding of the invention, reference numerals in the drawings denote one of a multitude of operating wells since all of them are essentially similar.

Figure 2:
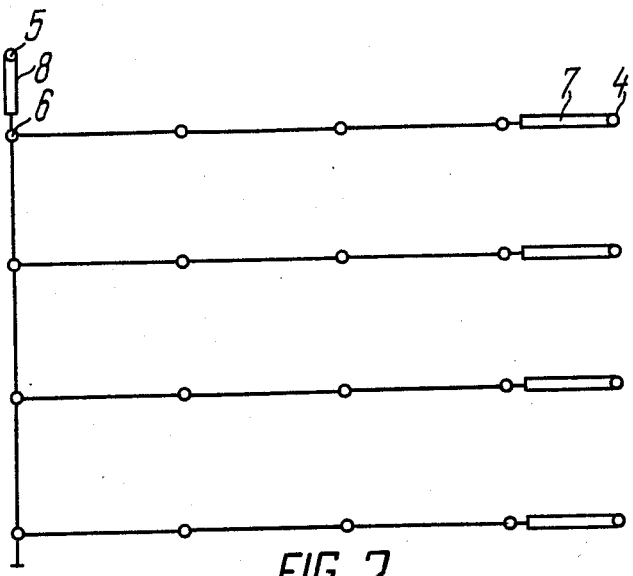
FIG. 2 shows arrangement of wells in plan according to the invention.

FIG. 1 shows arrangement of the wells 4 drilled beyond the rock shift zone limited by a shift angle $\gamma$. The gas is removed through the wells 4 connected with the wells 5 and 6 into which a gaseous medium is supplied.

When gasification is performed in descending order, the seam 2 in the series is gasified after the seam 1 has been gasified provided that the rock overlying a degasified space 9 of the seam 1 is no longer shifted.

FIG. 1 illustrates preparation of the seam 2 for gasification after the seam 1 has been gasified and the rock shift has stopped.

To decrease rock deformation, a firing boundary 10 of the coal seam 2 is displaced relative to a firing boundary 11 of the coal seam 1 by an amount (1) equal to a first spacing of rock caving in the roof of the seam 1.

This is done to decrease a crumbling rock zone over the degasified space near the firing boundary 10, said zone being particularly large in cutting the series of said seams when the boundaries 10 and 11 defining initial gasification of the seams coincide in plan, and to improve interconnection conditions when a firing floor of the underlying seam is located under a coal pillar and not under the degasified space.

When the series of said coal seams is to be gasified in descending order, gasification begins with the upper coal seam 1, which permits subsequent preparation of the underlying seams 2 and 3 for gasification (interconnection of the wells), said underlying seams being unaffected by the rock shift. In gasification of the underlying seams 2 and 3 of said series, use is made of a part of the vertical wells 6 deepened by drilling to reach the overlying seam 1. This is done by drilling wells having a larger diameter down to the upper seam 1 whereupon said wells are deepened by drilling out to obtain a smaller diameter.

If the thickness of seam-spacing rock is such that, in the event of caving, the degasified spaces of the upper and lower seams may be interconnected, a clay or similar stowage material is supplied into the degasified space 9 of the overlying seam 1 through the wells 6 before gasification of the underlying layer 2, to hermetically seal a gas producer arranged within the underlying seam.

Figure 3:
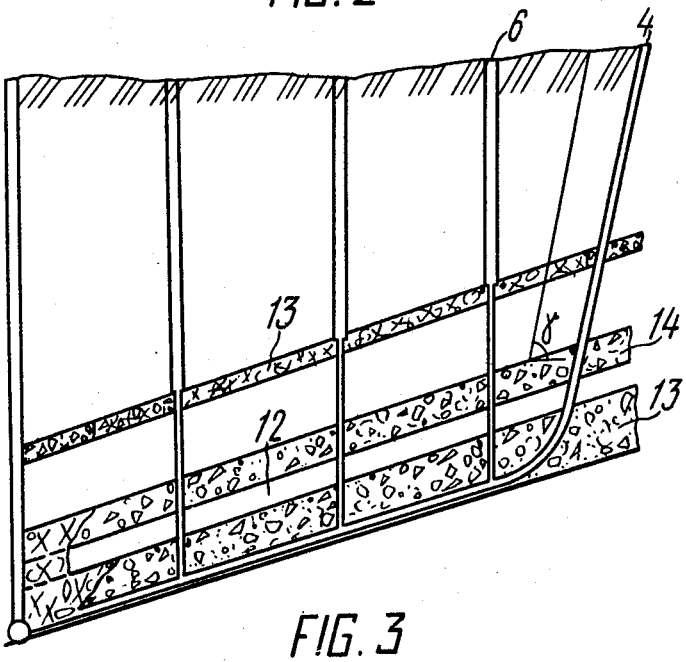
FIG. 3 shows diagrammatically arrangement of the wells across the series of said coal seams according to the invention.

If the thickness of seam-spacing rock 12 (FIG. 3) is smaller than half a thickness of a seam 13 (in the presence of several seams), the seams are gasified in descending order, two seams (13 and 14) being gasified at a time if $H_2 < H$ where $H_2$ is determined from the total seam thickness: $H_2 = n(m_1 + m_2)$ ($m_1$ is the thickness of the seam 14 and $m_2$ is the thickness of the seam 13). The underlying seam 13 is prepared for gasification, and the overlying seam 14 is gasified as the seam-spacing rock 12 is caved. The underlying seams, if available, are gasified after the seams 13 and 14 are gasified, a stowage material is supplied into the degasified space and the surface of the earth is still.

When the seams 1, 2 and 3 (FIG. 1) in the series are to be gasified in ascending order, gasification begins with the lower seam 3 in the series, the overlying seams 1 and 2 being gasified by the use of the vertical wells 6 drilled to reach the lower seam 3. This is done by stopping up the lower portion of the wells 6 and perforating a column on a floor of the respective seam in said series.

The invention makes it possible to effectively gasify a series of gently dipping and inclined coal seams under various mining conditions.

What is claimed is:

1. A method of underground gasification of a series of gently dipping and inclined coal seams comprising the steps of:

determining the depth of occurrence and the thickness of each coal seam in a series;

determining a safe mining depth for each coal seam in said series;

opening said coal seams by drilling operating injection and production wells;

interconnecting said drilled operating wells within the seam to be gasified;

setting the coal afire and establishing gasification passages within said coal seam;

gasifying each subsequent seam on completion of gasification of the preceding seam by supplying a gaseous medium into the first wells and removing the produced gas from the second wells, said gasification being effected upwards from the underlying seam to the overlying seams with a rock thickness therebetween exceeding a safe mining depth for the underlying seams or downwards from the overlying seam to the underlying seams with a rock thickness therebetween being smaller than the safe mining depth of the underlying seams, the gasification of the subsequent seam being effected after the rock overlying the gasified seam is no longer shifted, the shift thereof being associated with said gasification, a firing boundary of the underlying seam being shifted towards a coal pillar by an amount equal to or greater than a first spacing of rock caving in the roof of the gasified seam.

2. A method as claimed in claim 1, wherein the safe mining depth H for each seam in the series is determined from the formula $$H = n \cdot m \text{ at } H < H_1$$

where m is the thickness of the coal seam in the series;

$H_1$ is the depth of occurrence of the coal seam in the series; and n is a coefficient accounting for propagation of cracks in the event of rock caving in the roof.

3. A method as claimed in claim 2, wherein during gasification of the series of said coal seams in descending order with the height of a zone in which rock is caved due to gasification of each seam exceeding the rock thickness between the contiguous layers, gasification of the underlying seam is preceded by stopping up the degasified space overlying the used seam with a fluid stowage material.

4. A method as claimed in claim 2, wherein in gasification of the series in descending order with the rock thickness between the contiguous seams being less than half a thickness of the underlying coal seam, two adjacent coal seams are gasified simultaneously by gasifying the underlying seam and involving gasification of the overlying seam after the rock between said seams is caved.

5. A method as claimed in claim 2, wherein during gasification of the series of said coal seams in ascending order, gasification of the overlying seam is preceded by stopping up a lower portion of a substantially vertical well connected to the underlying seam and perforating a column on a floor of the respective seam.

* * * * *